United States Patent [19]

Ferrari

[11] Patent Number: 5,050,801

[45] Date of Patent: Sep. 24, 1991

[54] LAWN SPRINKLER

[76] Inventor: Ruggero Ferrari, St. Naviglia 11/A 43100, Parma, Italy

[21] Appl. No.: 536,430

[22] Filed: Jun. 11, 1990

[51] Int. Cl.[5] ..... B05B 15/10

[52] U.S. Cl. ..... 239/211; 239/251; 239/276; 239/288.5; 239/289

[58] Field of Search ..... 239/17, 211, 251, 276, 239/288, 288.3, 288.5, 289, 204

[56] References Cited

U.S. PATENT DOCUMENTS

| | | | |
|---|---|---|---|
| 1,863,919 | 6/1932 | Brooks | 239/204 |
| 1,989,525 | 1/1935 | Moore | 239/211 |
| 2,261,653 | 11/1941 | Lewis | 239/211 X |
| 2,323,701 | 7/1943 | Barksdale | 239/276 X |
| 2,811,808 | 11/1957 | Briese | 239/211 X |
| 3,709,435 | 1/1973 | Sheets | 239/204 |
| 3,801,014 | 4/1974 | Cantales | 239/288.5 X |
| 3,944,138 | 3/1976 | Easton | 239/18 |
| 3,994,310 | 11/1976 | Brandon | 239/288.3 X |
| 4,205,785 | 6/1980 | Stanley | 239/211 X |

FOREIGN PATENT DOCUMENTS

| | | | |
|---|---|---|---|
| 1513711 | 6/1978 | United Kingdom | 239/288.5 |

*Primary Examiner*—Andres Kashnikow
*Assistant Examiner*—William Grant
*Attorney, Agent, or Firm*—Wayne L. Lovercheck; Charles L. Lovercheck; Dale Lovercheck

[57] ABSTRACT

A combination ornament in the form of a flower and a sprinkler head is provided. The flower is made up of petals and is swingably supported on the sprinkler head. A piston in the sprinkler head is actuated by a water supply which moves the piston upward to move the petals downward out of line with the sprinkler head. A spring is provided in the sprinkler head for forcing the piston downward when the water supply is shut off, for moving the piston and the petals to a closed position.

16 Claims, 3 Drawing Sheets

LAWN SPRINKLER

BACKGROUND OF THE INVENTION

This invention relates to sprinklers and more particularly to a lawn sprinkler in combination with a flower. The prior art includes various lawn sprinklers which in general are not aesthetically appealing. Apparatus having a very general similarity to the apparatus of the present invention include U.S. Pat. No. 3,944,138 to Easton which discloses a lawn sprinkler having a head shaped like a flower, and U.S. Pat. No. 1,989,525 to Moore having a head shaped like flowers whose stems can be bent to direct the flow of water.

SUMMARY OF THE INVENTION

The invention comprises a sprinkler body that can be connected to a garden type watering hose. A piston attached to a sprinkler head is slidable in the body. Flower petals are pivoted to the body and have a lever that attaches to the petals which engages a piston means. Water pressure from a suitable supply moves the piston to an upper position thereby swinging the petals downward to a lowered position out of way of the water from the nozzle. All of the water flowing through the piston is discharged through spray nozzles, passes clear of the petals onto the area to be watered.

It is an object of the invention to provide an improved ornamental lawn watering device.

Another object of the invention is to provide a lawn watering device that is simple in construction, economical to manufacture and simple and efficient to use.

Another object is to provide a combination lawn sprinkler and a flower or ornament.

Another object of the invention is to provide a lawn watering device which the petals of a flower conceal the water jets when not in operation.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENTS

Figure 1:
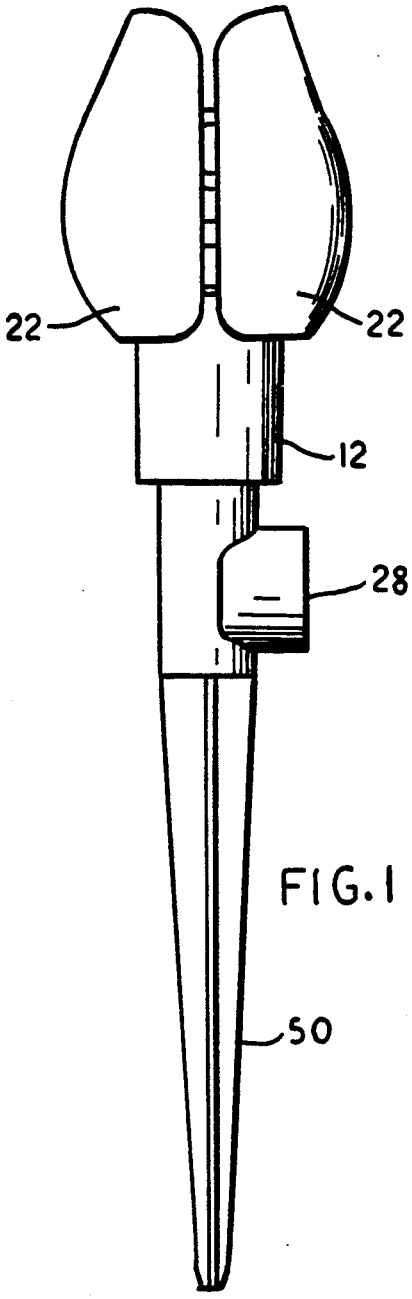
FIG. 1 is a side view of the sprinkler and flower with the petals closed.
Figure 2:
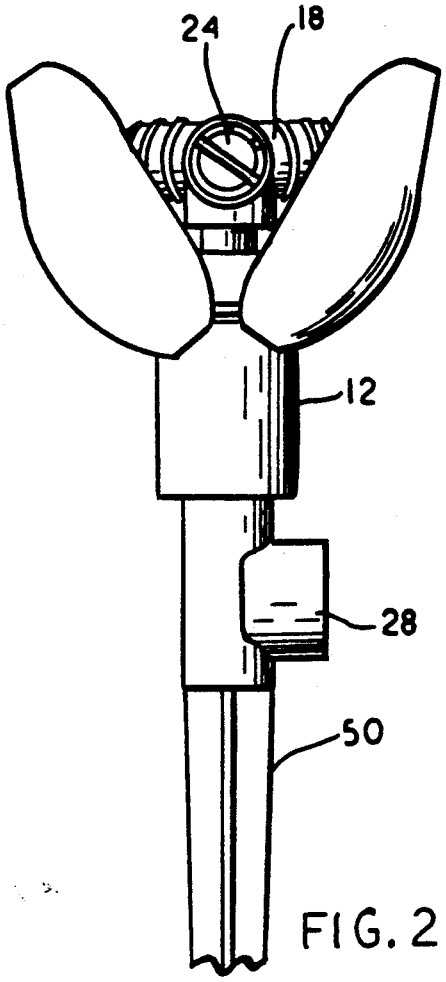
FIG. 2 is a side view of the sprinkler with the petals in an open position.
Figure 3:
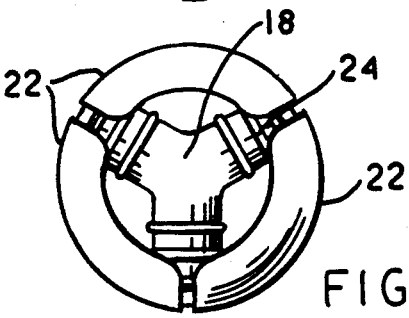
FIG. 3 is a top view of the sprinkler with the petals closed.
Figure 4:
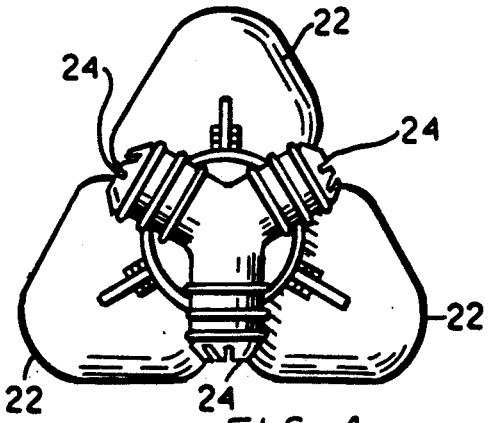
FIG. 4 is a top view of the sprinkler with the petals open.
Figure 6:
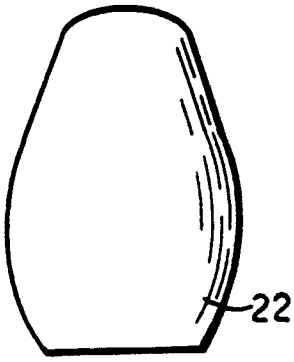
FIG. 6 is a side view of one of the petals.
Figure 7:
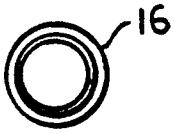
FIG. 7 is a bottom view of the piston shown in FIG. 5.
Figure 8:
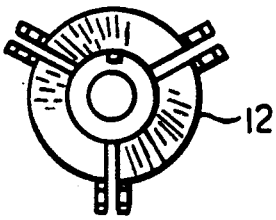
FIG. 8 is a top view of the sprinkler support body shown in FIG. 5.
Figure 9:
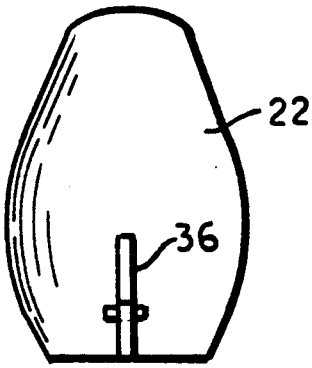
FIG. 9 is a side view of one of the petals.
Figure 5:
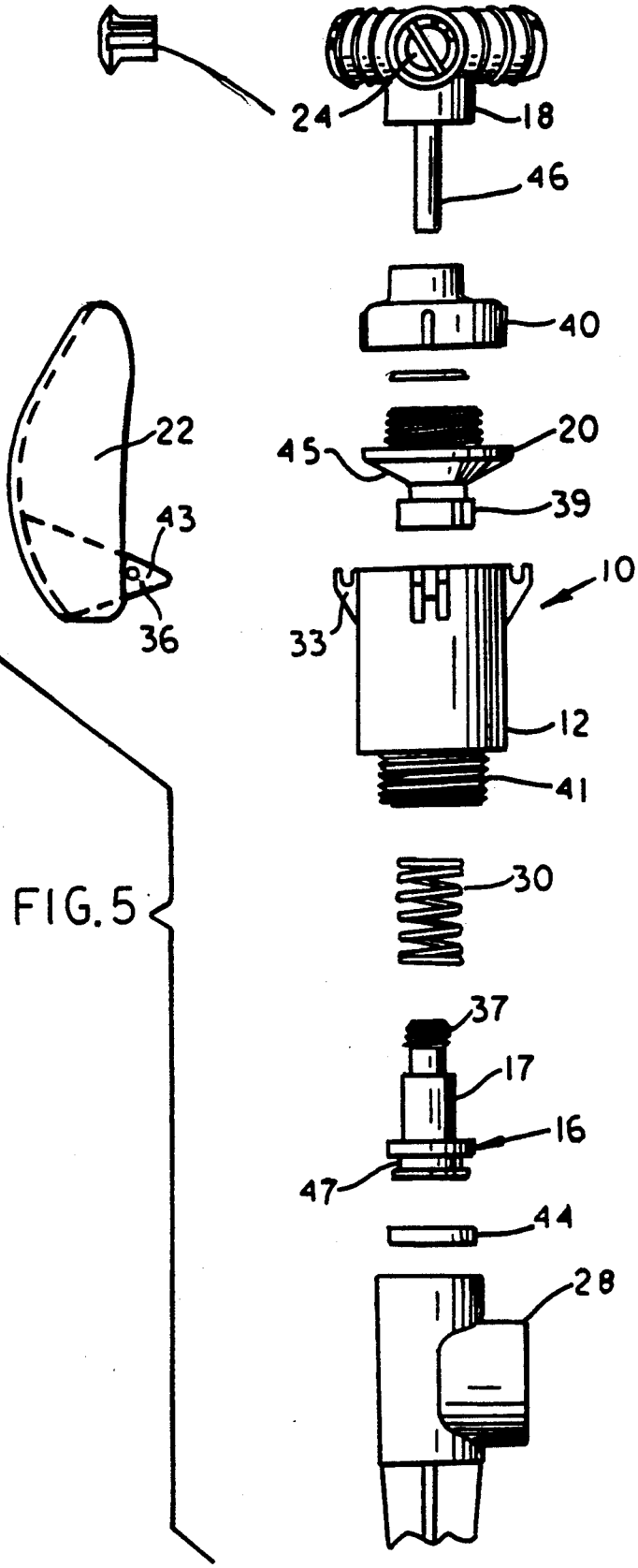
FIG. 5 is an exploded view of the sprinkler and petals.
Figure 10:
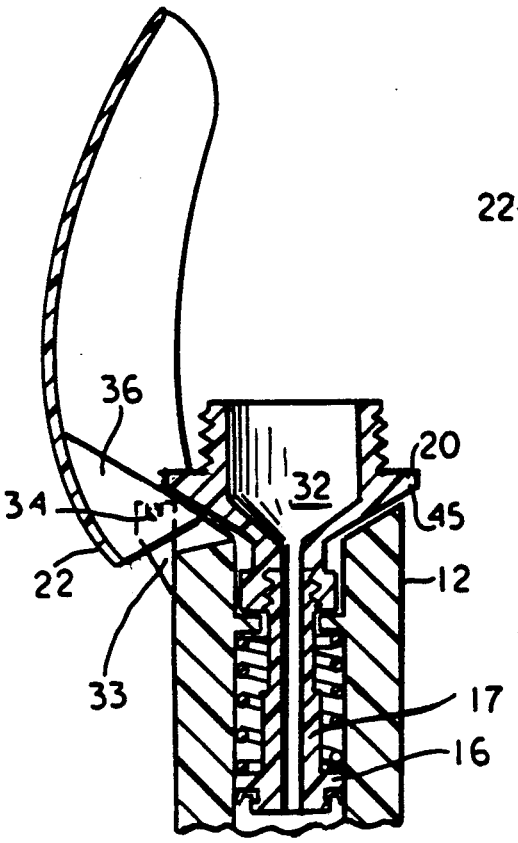
FIG. 10 is a partial longitudinal cross sectional view of the sprinkler with one (1) petal in a closed position.
Figure 12:
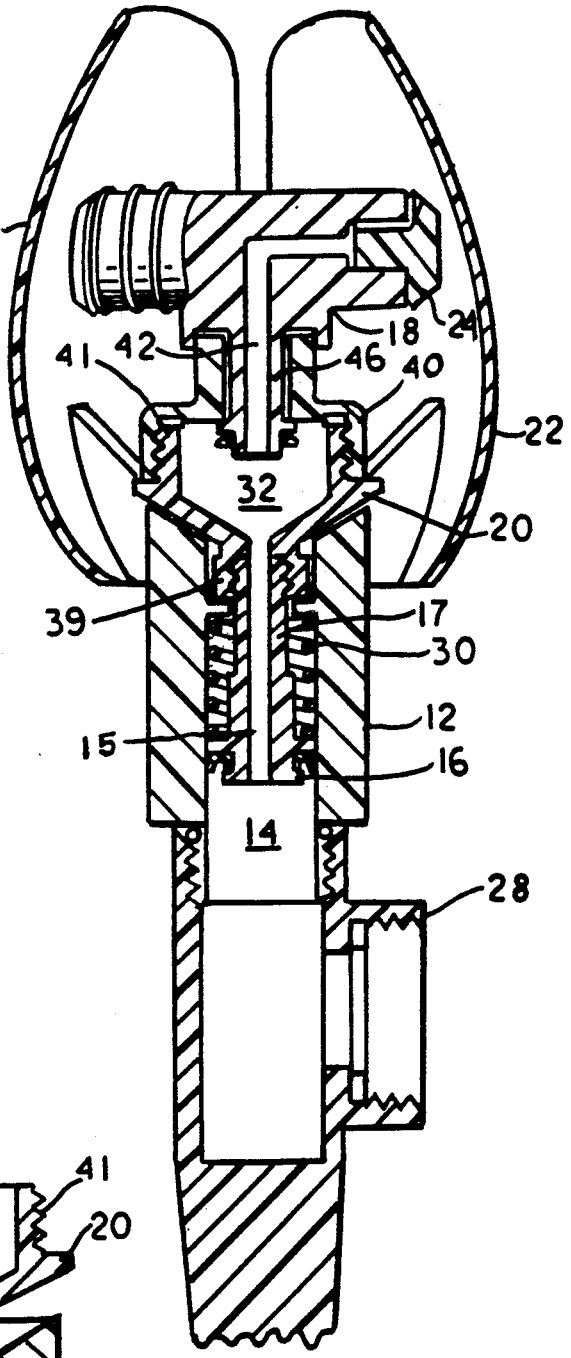
FIG. 12 is a longitudinal cross sectional view of the sprinkler and petals.
Figure 11:
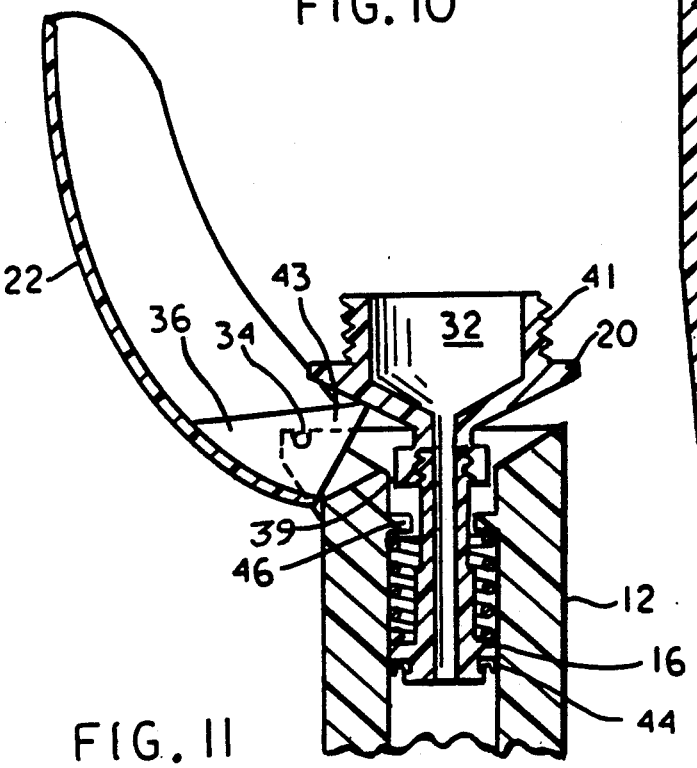
FIG. 11 is a partial view, similar to FIG. 10 with petals closed.

Now with more particular reference to the drawings, sprinkler 10 has body 12 which has cylindrical cavity 14 therein. Cavity 14 has a water actuated means in the form of piston 16 slidably supported therein. Piston 16 has piston rod 17 threaded at upper end 37 which is threadably received in internally threaded end 39 of sprinkler support 20. Sprinkler support 20 has chamber 32 and an externally threaded upper end that is received in internally threaded lower end 41 of bearing support 40. Bearing support 40 has a bore in its upper end that rotatably receives pin 46 which is integrally attached to sprinkler head 18. An ornament in the shape of a flower made up of a plurality of petals 22 has integral levers 36 that are swingably attached to lugs 33 on body 12 by pivots 34.

Each lever 36 terminates at point 43. Point 43 engages frustoconical shaped flange 45 on sprinkler support 20 for moving petals 22 to a closed position when piston 16 is forced downward by spring 30 when water is shut off. Petals 22 swing to an open position when piston 16 rises when water is introduced through water connection 28 and channel 15 in piston rod 17 to cavity 14 of body 12. Water in cavity 14 exerts a force on the lower side of piston 16 due to the restricted passage through channel 15 moving piston 16 upward and with it sprinkler head 18. Thus frustoconical shaped flange 45 moves up with sprinkler support 20 allowing petals 22 to swing downward out of the line of discharge from jet members 24.

Water from chamber 32 passes through passage 42 in sprinkler head 18 and out of jet members 24 giving a tangential force on sprinkler head 18 and discharging water onto the area to be watered in a manner familiar to those skilled in the art. Jet members 24 are of a conventional type that have grooves around the outer periphery.

The lower end of piston 16 has piston ring 44 in groove 47 which prevents water from flowing around piston 16. Sprinkler 10 may be supported by spike 50 on the lower end of body 12, which may be inserted in the ground.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privledge is claimed are defined as follows:

1. In combination a sprinkler having a sprinkler head and a body, and an ornament supported on said body, said ornament comprises a flower having a plurality of petals, each said petal being swingably supported on said body, a water actuated means on said body adapted to move said ornament from a first position obscuring said sprinkler head to a second position exposing said sprinkler head, said water actuated means comprises a piston having a piston rod engaging said petals for swinging said petals to an open position.

2. The combination recited in claim 1 wherein said body has a cavity, a sprinkler support connecting said piston to said sprinkler head, a chamber in said sprinkler support, a channel extending through said piston and said piston rod connecting said cavity to said chamber whereby water pressure in said cavity reacts on said water actuated means moving said petals to said open position.

3. The combination recited in claim 2 wherein a spring is supported in said cavity, said spring adapted to urge said water actuated means to a downward position.

4. The combination recited in claim 3 wherein said sprinkler head is rotatably supported on said body, said sprinkler head having jet members thereon actuated by water discharged therethrough to rotate said sprinkler head.

5. A sprinkler comprising a body having a cavity therein, a piston in said cavity, a sprinkler head, a springkler head support having a chamber therein rotatably supporting said sprinkler head on said piston, a plurality of petals swingably supported on said body, a spring supported in said cavity and engaging said piston and urging said piston to a downward position, a lever fixed to each said petal, said sprinkler support having lever engaging means, said lever engaging means engaging said lever to move said petals, a water connection connected to said body and adapted to direct water to said cavity against said piston urging said piston upward and moving said petals to an open position and to discharge said water through said sprinkler head.

6. The sprinkler recited in claim 5 wherein said piston has a piston rod attached to said sprinkler head, said piston rod has a channel connecting said cavity to said chamber, said channel being of substantially lesser capacity than water from said water connection whereby a force is exerted by said water on said piston.

7. The sprinkler recited in claim 5 wherein said piston has a channel therein connecting said cavity to a chamber in said support whereby said water enters said sprinkler head and said water in said sprinkler head reacts to rotate said sprinkler head.

8. The sprinkler recited in claim 5 wherein said cavity is in the form of a cylinder receiving said piston.

9. The sprinkler recited in claim 8 wherein said sprinkler head has jet members thereon to rotate said sprinkler head.

10. In combination a sprinkler and an ornament.

said sprinkler having a sprinkler head and a body said ornament supported on said body, a water actuated means on said body adapted to move said ornament from a first position obscuring said sprinkler head to a second position exposing said sprinkler head, said ornament comprises a flower having a plurality of petals, each said petal being swingably attached to said body.

11. The combination recited in claim 10 wherein said water actuated means comprises a piston having a piston rod engaging said petals for swinging said petals to an open position.

12. The combination recited in claim 11 wherein said body has a cavity, a sprinkler support connecting said piston to said sprinkler head, a chamber in said sprinkler support, a channel extending through said piston and said piston rod connecting said cavity to said chamber whereby said water pressure in said cavity reacts on said water actuated means moving said petals to said open position.

13. In combination a sprinkler and an ornament, said sprinkler having a sprinkler head and a body, said ornament supported on said body, a water actuated means on said body adapted to move said ornament from a first position obscuring said sprinkler head to a second position exposing said sprinkler head, said water actuated means comprises a piston having a piston rod engaging said ornament for swinging said ornament to an open position.

14. The combination recited in claim 13 wherein said body has a cavity, a sprinkler support connecting said piston to said sprinkler head, a chamber in said sprinkler support, a channel extending through said piston and said piston rod connecting said cavity to said chamber whereby water pressure in said cavity reacts on said water actuated means moving said ornament to said open position.

15. The combination recited in claim 14 wherein a spring is supported in said cavity, said spring adapted to urge said water actuated means to a downward position.

16. The combination recited in claim 15 wherein said sprinkler head is rotatably supported on said body, said sprinkler head having jet members actuated by water discharged therethrough to rotate said sprinkler head.

* * * * *